US006822618B2

(12) United States Patent
Bisiules et al.

(10) Patent No.: US 6,822,618 B2
(45) Date of Patent: Nov. 23, 2004

(54) FOLDED DIPOLE ANTENNA, COAXIAL TO MICROSTRIP TRANSITION, AND RETAINING ELEMENT

(75) Inventors: Peter John Bisiules, LaGrange Park, IL (US); Chin Shun-Yang, Naperville, IL (US); Gang Yi Deng, Orland Park, IL (US); John Stewart Wilson, Downers Grove, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/390,487

(22) Filed: Mar. 17, 2003

(65) Prior Publication Data

US 2004/0183739 A1 Sep. 23, 2004

(51) Int. Cl.[7] ..... H01Q 21/00
(52) U.S. Cl. ..... 343/803; 343/793
(58) Field of Search ..... 343/793, 803

(56) References Cited

U.S. PATENT DOCUMENTS

| | | | | | |
|---|---|---|---|---|---|
| 3,680,135 | A | * | 7/1972 | Boyer | 343/742 |
| 4,686,536 | A | | 8/1987 | Allcock | |
| 4,837,529 | A | | 6/1989 | Gawronski et al. | |
| 5,532,707 | A | | 7/1996 | Klinger et al. | |
| 5,539,414 | A | | 7/1996 | Keen | |
| 5,724,051 | A | | 3/1998 | Mailandt et al. | |
| 5,821,902 | A | | 10/1998 | Keen | |
| 5,917,456 | A | | 6/1999 | Teunisse | |
| 5,936,590 | A | | 8/1999 | Funder | |
| 6,034,649 | A | | 3/2000 | Wilson et al. | |
| 6,072,439 | A | * | 6/2000 | Ippolito et al. | 343/797 |
| 6,121,929 | A | | 9/2000 | Olson et al. | |
| 6,285,336 | B1 | | 9/2001 | Zimmerman | |
| 6,317,099 | B1 | | 11/2001 | Zimmerman et al. | |
| 6,333,720 | B1 | * | 12/2001 | Gottl et al. | 343/810 |
| 6,529,172 | B2 | * | 3/2003 | Zimmerman | 343/797 |
| 2002/0021257 | A1 | | 2/2002 | Zimmerman | |
| 2002/0126059 | A1 | | 9/2002 | Zimmerman et al. | |
| 2002/0135520 | A1 | | 9/2002 | Teillet al. | |
| 2002/0135524 | A1 | | 9/2002 | Zimmerman et al. | |
| 2002/0135528 | A1 | | 9/2002 | Teillet et al. | |

FOREIGN PATENT DOCUMENTS

| | | |
|---|---|---|
| EP | 1 132 997 B1 | 8/2002 |

* cited by examiner

*Primary Examiner*—James Vannucci
(74) *Attorney, Agent, or Firm*—Welsh & Katz, Ltd.

(57) ABSTRACT

A dual polarized folded dipole antenna comprising: a first unit configured for transmitting and/or receiving signals in a first polarization direction; and a second unit configured for transmitting and/or receiving signals in a second polarization direction. Each unit includes an integrally formed feed section a radiator input section, and radiating section. The feed section is a microstrip feed section, and the radiator input section includes a balun transformer.

The antenna has a coaxial to microstrip transition comprising a microstrip transmission line on a first side of the ground plane; and a coaxial transmission line on a second side of the ground plane opposite to the first side of the ground plane. A conductive ground transition body is in conductive engagement with the sleeve of the coaxial line; and a ground locking member applies a force to the ground transition body so as to force the ground transition body into conductive engagement with the ground plane. A conductive line transition body is provided in conductive engagement with the central conductor, and a line locking member apples a force to the line transition body so as to force the line transition body into conductive engagement with the microstrip line.

Adjacent dipole ends are retained together by electrically insulating retaining elements. Each element comprises a body portion having a pair of sockets on opposite side of the body portion; and a pair of resilient members which each obstruct a respective socket and resiliently flex, when in use, to admit an end of a dipole into the socket.

18 Claims, 13 Drawing Sheets

FOLDED DIPOLE ANTENNA, COAXIAL TO MICROSTRIP TRANSITION, AND RETAINING ELEMENT

FIELD OF THE INVENTION

A first aspect of the present invention relates generally to folded dipole antennas. A second aspect of the present invention relates to a coaxial to microstrip transition. A third aspect of the present invention relates to a retaining element. All aspects of the invention are typically but not exclusively for use in wireless mobile communications systems

BACKGROUND OF THE INVENTION

U.S. Pat. No. 6,317,099 and U.S. Pat. No. 6,285,666 describe a folded dipole antenna with a ground plane; and a conductor having a microstrip feed section extending adjacent the ground plane and spaced therefrom by a dielectric, a radiator input section, and at least one radiating section integrally formed with the radiator input section and the feed section. The radiating section includes first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends.

The radiating section is driven with a feed which is not completely balanced. An unbalanced feed can lead to unbalanced currents on the dipole arms which can cause beam skew in the plane of polarization (vertical pattern for a v-pol antenna, horizontal pattern for a h-pol antenna, vertical and horizontal patterns for a slant pol antenna), increased cross-polar isolation in the far field and increased coupling between polarizations for a dual polarized antenna.

A stripline folded dipole antenna is described in U.S. Pat. No. 5,917,456. A disadvantage of a stripline arrangement is that a pair of ground planes is required, resulting in additional expense and bulk.

U.S. Pat. No. 4,837,529 describes a microstrip to coaxial side-launch transition. A microstrip transmission line is provided on a first side of a ground plane, and a coaxial transmission line is provided on a second side of the ground plane opposite to the first side of the ground plane. The coaxial transmission line has a central conductor directly soldered to the microstrip line. Direct soldering to the microstrip line has a number of disadvantages. Firstly, the integrity of the joint cannot be guaranteed. Secondly, it is necessary to construct the microstrip line from a metal which allows the solder to flow. The coaxial cylindrical conductor sleeve is also directly soldered to the ground plane. Direct soldering to the ground plane has the disadvantages given above, and also the further disadvantage that the ground plane will act as a large heat sink, requiring a large amount of heat to be applied during soldering.

BRIEF DESCRIPTION OF EXEMPLARY EMBODIMENT

An exemplary embodiment provides in a first aspect a dual polarized folded dipole antenna comprising:

a first unit configured for transmitting and/or receiving signals in a first polarization direction; and a second unit configured for transmitting and/or receiving signals in a second polarization direction different to the first polarization direction, wherein each unit includes a conductor having a feed section, a radiator input section, and at least one radiating section integrally formed with the radiator input ,section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends.

The exemplary embodiment provides in a second aspect a folded dipole antenna comprising:

a ground plane a conductor having a feed section extending adjacent the ground plane and spaced therefrom by a dielectric, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends, wherein the feed section is a microstrip feed section having an adjacent ground plane on one side only, and wherein the radiator input section includes a balun transformer.

The balun transformer provides a balanced feed and obviates the problems discussed above.

The exemplary embodiment provides in a third aspect a folded dipole antenna comprising:

a ground plane a conductor having a feed section extending adjacent the ground plane and spaced therefrom by a dielectric, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends, wherein the feed section is a microstrip feed section having an adjacent ground plane on one side only, and wherein the radiator input section includes a splitter, first and second feedlines which meet said feed section at said splitter so as to complete a closed loop including the first and second feedlines and the radiating section, and a phase delay element for introducing a phase difference between the first and second feedlines.

The exemplary embodiment provides in a fourth aspect a coaxial to microstrip transition comprising:

a ground plane;

a microstrip transmission line on a first side of the ground plane;

a coaxial transmission line on a second side of the ground plane opposite to the first side of the ground plane, the coaxial transmission line having a central conductor coupled to the microstrip line, a coaxial cylindrical conductor sleeve coupled to the ground plane, and a dielectric material between the central conductor and the sleeve, a conductive ground transition body in conductive engagement with the sleeve; and a ground locking member applying a force to the ground transition body so as to force the ground transition body into conductive engagement with the ground plane.

This construction obviates the need for a direct solder joint between the sleeve and the ground plane.

The exemplary embodiment provides in a fifth aspect a coaxial to microstrip transition comprising:

a ground plane;

a microstrip transmission line on a first side of the ground plane;

a coaxial transmission line on a second side of the ground plane opposite to the first side of the ground plane, the coaxial transmission line having a central conductor coupled to the microstrip line, a coaxial cylindrical conductor sleeve coupled to the ground plane, and a dielectric material between the central conductor and the sleeve, a conductive line transition body in conductive engagement with the central conductor; and a line locking member applying a force to the line transition body so as to force the line transition body into conductive engagement with the microstrip line.

This construction obviates the need for a direct solder joint between the central conductor and the microstrip line.

The exemplary embodiment provides in a sixth aspect a method of constructing a coaxial to microstrip transition, the method comprising:

arranging a microstrip transmission line on a first side of a ground plane;

arranging a coaxial transmission line on a second side of the ground plane opposite to the first side of the ground plane, the coaxial transmission line having a central conductor coupled to the microstrip line, a coaxial cylindrical conductor sleeve coupled to the ground plane, and a dielectric material between the central conductor and the sleeve, arranging a conductive ground transition body in conductive engagement with the sleeve; and applying a force to the ground transition body so as to force the ground transition body into conductive engagement with the ground plane.

The exemplary embodiment provides in a seventh aspect a method of constructing a coaxial to microstrip transition, the method comprising:

arranging a microstrip transmission line on a first side of a ground plane;

arranging a coaxial transmission line on a second side of the ground plane opposite to the first side of the ground plane, the coaxial transmission line having a central conductor coupled to the microstrip line, a coaxial cylindrical conductor sleeve coupled to the ground plane, and a dielectric material between the central conductor and the sleeve, arranging a conductive line transition body in conductive engagement with the central conductor; and applying a force to the line transition body so as to force the line transition body into conductive engagement with the microstrip line.

The exemplary embodiment provides in an eighth aspect an electrically insulating retaining element for retaining together adjacent ends of a pair of dipoles, the element comprising a body portion having a pair of sockets on opposite side of the body portion; and a pair of resilient members which each obstruct a respective socket and resiliently flex, when in use, to admit an end of a dipole into the socket.

The exemplary embodiment provides in a ninth aspect a dipole assembly comprising two or more dipoles having adjacent ends retained together by electrically insulating retaining elements, each element comprising a body portion having a pair of sockets on opposite side of the body portion; and a pair of resilient members which each obstruct a respective socket and resiliently flex, when in use, to admit an end of a dipole into the socket.

BRIEF DESCRIPTION OF THE DRAWINGS

Illustrative embodiments of the invention will now be described with reference to the accompanying drawings to disclose the advantageous teachings of the present invention.

DESCRIPTION OF ILLUSTRATIVE EMBODIMENTS

Figure 1:
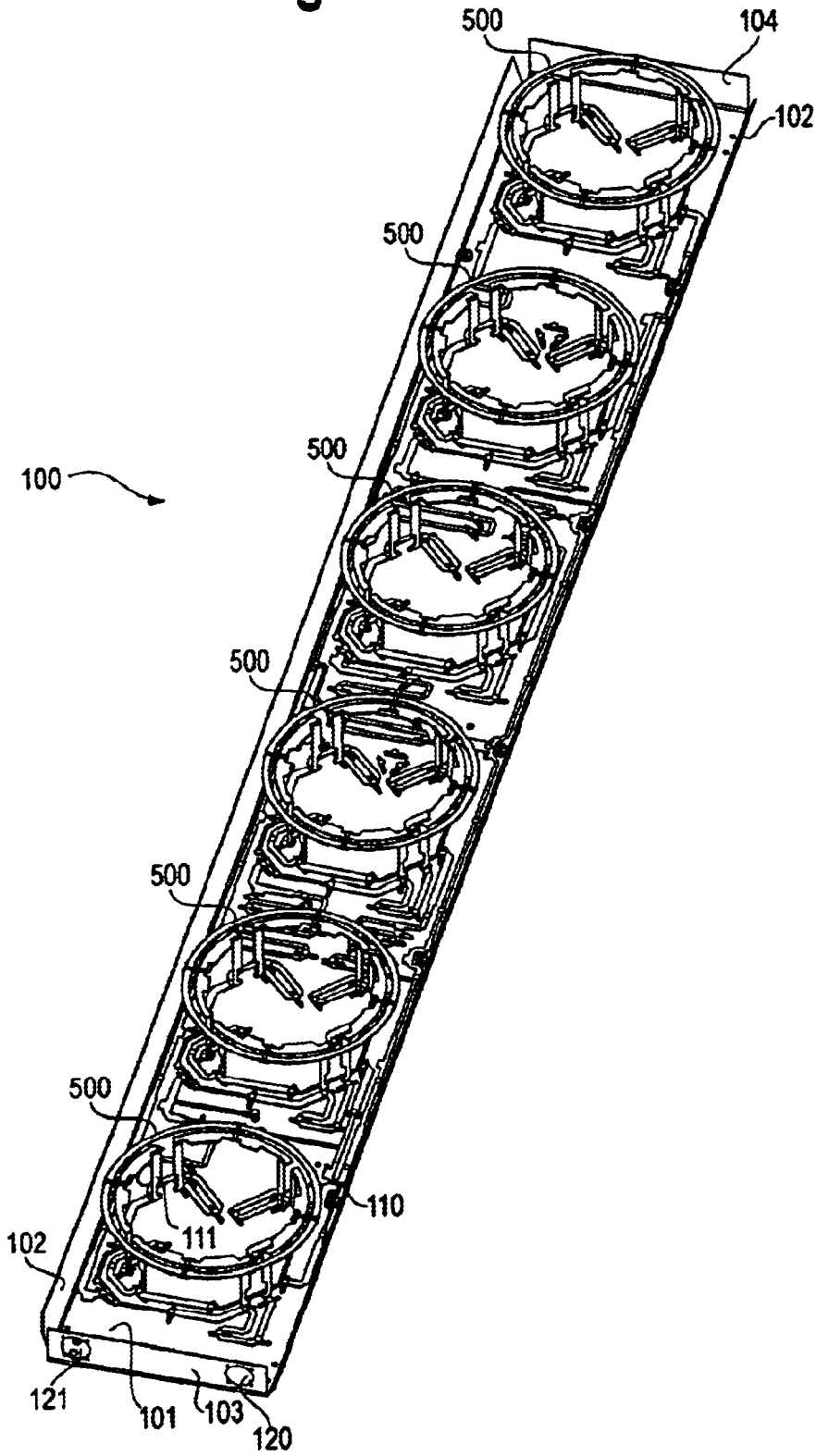
FIG. 1 is an isometric view of a dual polarization folded dipole antenna according to one embodiment of the present invention.
Figure 2:
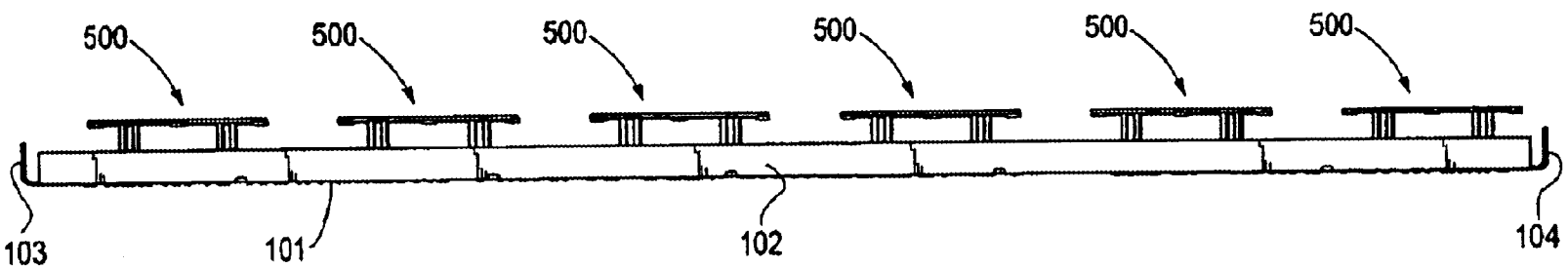
FIG. 2 is a side view of the dual polarization folded dipole antenna of FIG. 1.

FIGS. 1 and 2 show a slant polarized dual polarization folded dipole antenna 100 according to the invention. A reflector tray is formed by a ground plane 101, lower and upper end walls 103,104 and side walls 102. A +45° integrally formed microstrip antenna unit 300 (shown in FIG. 3) and a −45° integrally formed microstrip antenna unit 400 (shown in FIG. 4) are mounted adjacent, and substantially parallel to, the ground plane 101, as described in detail below. Together, the radiating sections of the microstrip antenna units 300,400 form a number of generally circular radiating modules 500 which are spaced apart along an antenna axis. The antenna is generally mounted is use on a base station mast with the antenna axis oriented in a vertical direction. The +45° antenna unit 300 radiates with a polarization at +45° to the antenna axis, while the −45° antenna unit 400 radiates with a polarization at −45° to the antenna axis.

Figure 3:
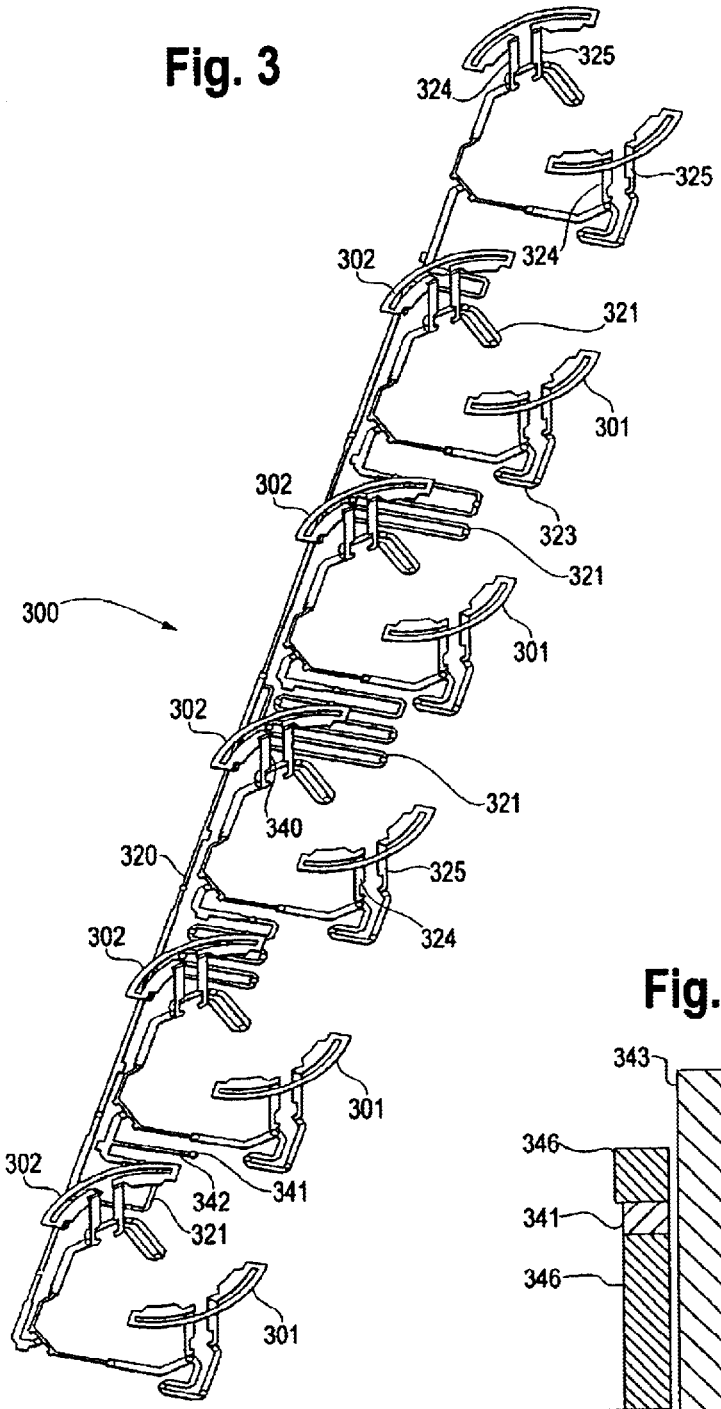
FIG. 3 is an isometric view of the +45° antenna unit.
Figure 3A:
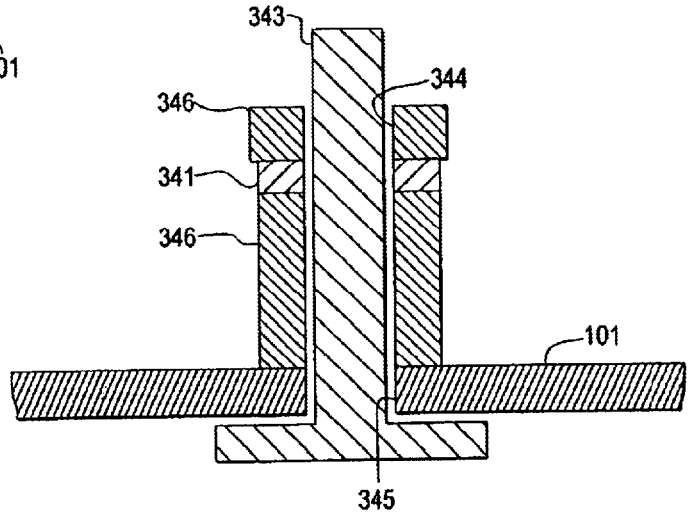
FIG. 3A is a cross-sectional view through a DC ground connection.

FIG. 3 shows the +45° microstrip antenna unit 300. The antenna unit comprises a feed section 320, radiator input sections (including dipole feed legs 324 and 325, and phase delay lines 322, 323) and radiating sections 301 and 302. The feed section, radiator input sections and radiating sections are formed integrally, by cutting or stamping from a flat sheet of conductive material such as, for example, a metal sheet comprised of aluminum, copper, brass or alloys thereof. Since the antenna unit is formed integrally, the number of mechanical contacts necessary is reduced, improving the intermodulation distortion (IMD) performance of the antenna 100. The feed section 320 branches out from a single RF input section 340 (partially obscured) that is electrically connected to a coaxial transmission line (not shown in FIGS. 1–4) via a transition shown in detail in FIGS. 9–13 and described in further detail below. The coaxial transmission line passes along the rear side of the ground plane 101, through one of the slots 110 or 111 in the ground plane (shown in FIG. 1) and through one of the holes 120 or 121 in the lower end wall 103. Many other paths for the transmission line may also be suitable. The transmission line is generally electrically connected to an RF device such as a transmitter or a receiver. In one embodiment, the RF input section 340 directly connects to the RF device. The feed section 320 also includes a DC ground connection, positioned at the end of a quarter wavelength stub 342. The DC ground connection is shown in cross-section in FIG. 3A. The stub 342 has a circular pad 341 at its end with a hole 344. A bolt 343 passes through the hole 344 and a hole 345 in the ground plane 101. A cylindrical metal spacer 346 has an external diameter greater than the internal diameters of the holes 344,345 and engages the pad 341 at one end and the ground plane 101 at the other end. The bolt 343 is threaded at its distal end and an internally threaded nut 346 compresses the pad 341 and the groundplane 101 together with a given torque to ensure a tight metal joint for good intermodulation performance.

The feed section 320 further includes a number of meandering phase delay lines 321, to provide a desired phase relationship between the radiating sections 301,302 and between the modules 500. In the embodiment shown in FIG. 3, the meandering phase delay lines 321 are configured so that the all radiating sections 301, 302 and all modules 500 are at the same phase. Alternatively the lines 321 may be configured to give a fixed phase difference (and hence downtilt) between the modules.

Figure 4:
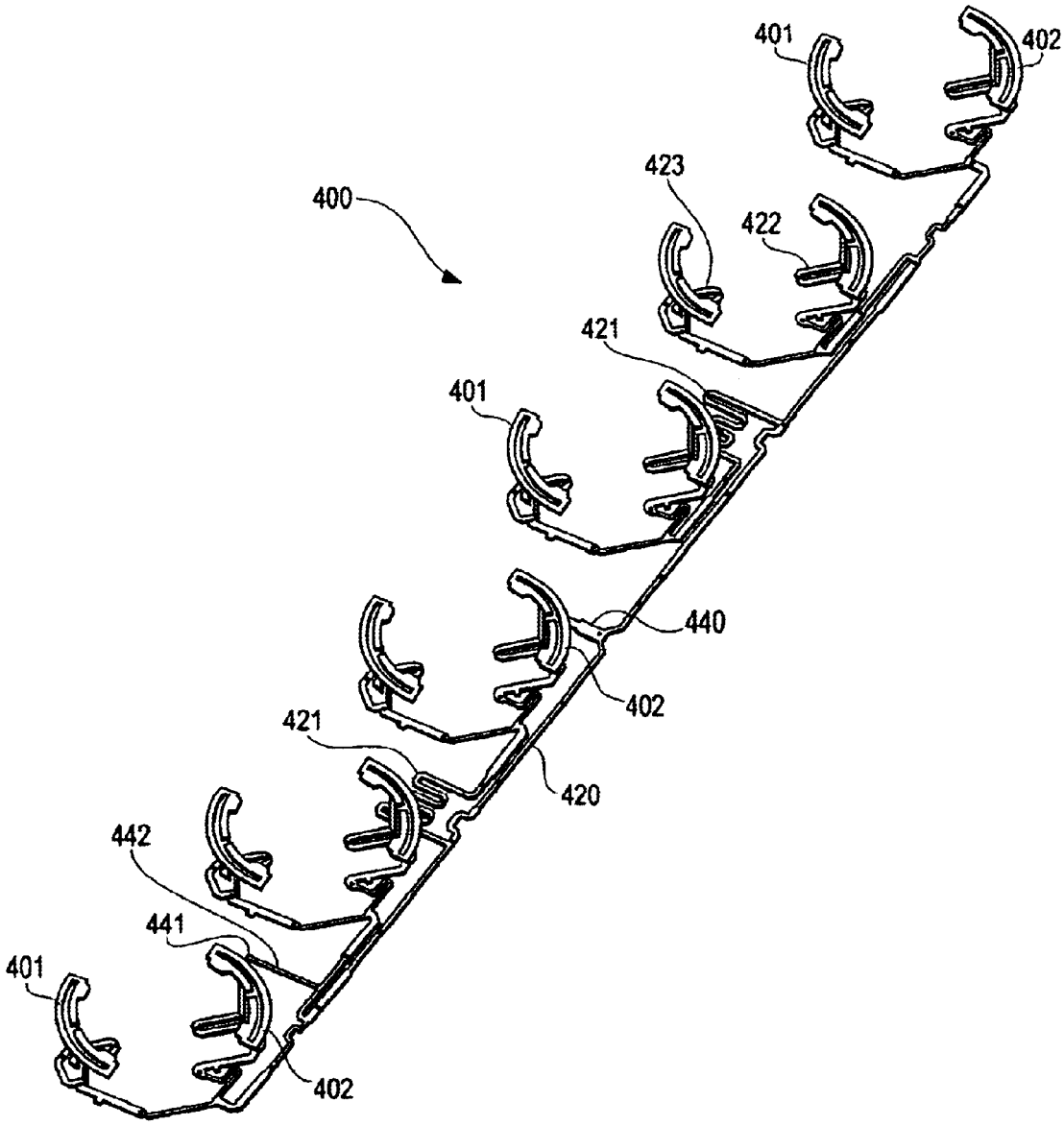
FIG. 4 is an isometric view of the −45° antenna unit.

FIG. 4 shows the −45° microstrip antenna unit 400. The unit is similar to the +45° antenna unit, and similar elements are given the same reference numerals, increased by 100. For instance the equivalent to the +45° radiating sections 301, 302 are −45° radiating sections 401,402. It will be seen by a comparison of FIGS. 3 and 4 that the +45° unit 300 and −45° unit 400 interlock together to form the dual-polarized modules 500.

Figure 5:
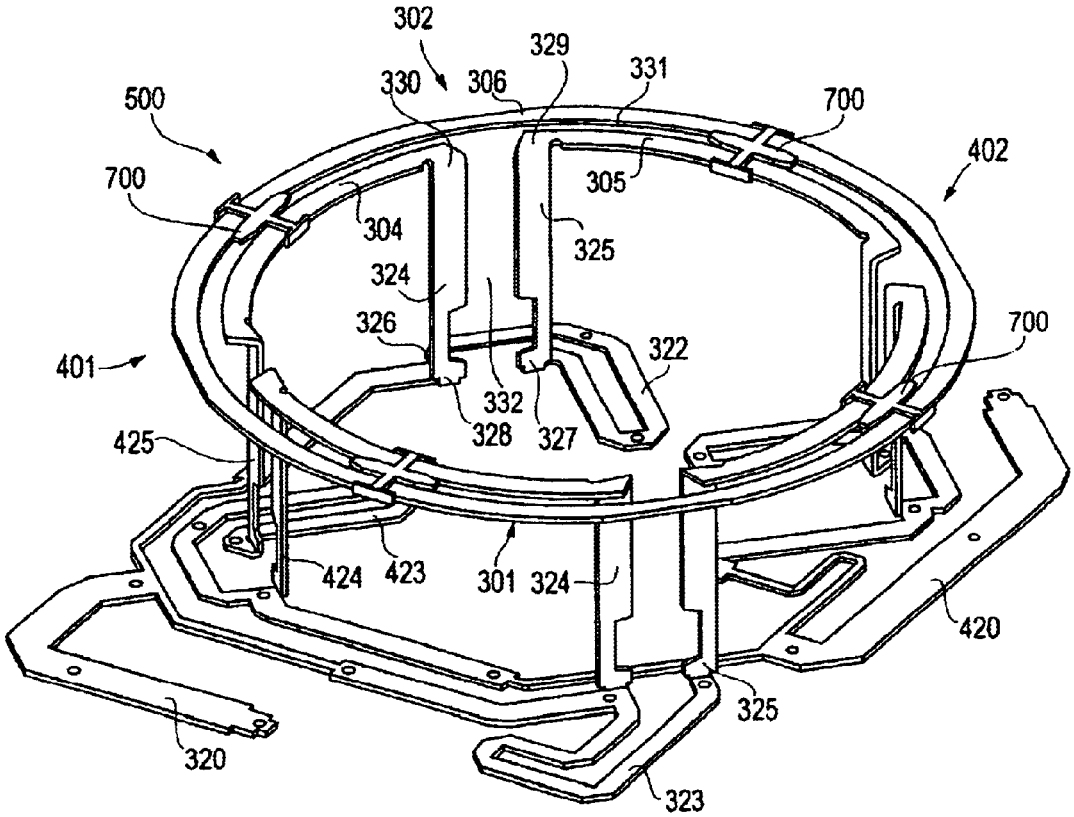
FIG. 5 is an isometric view of a single radiating module of the antenna of FIG. 1.
Figure 14:
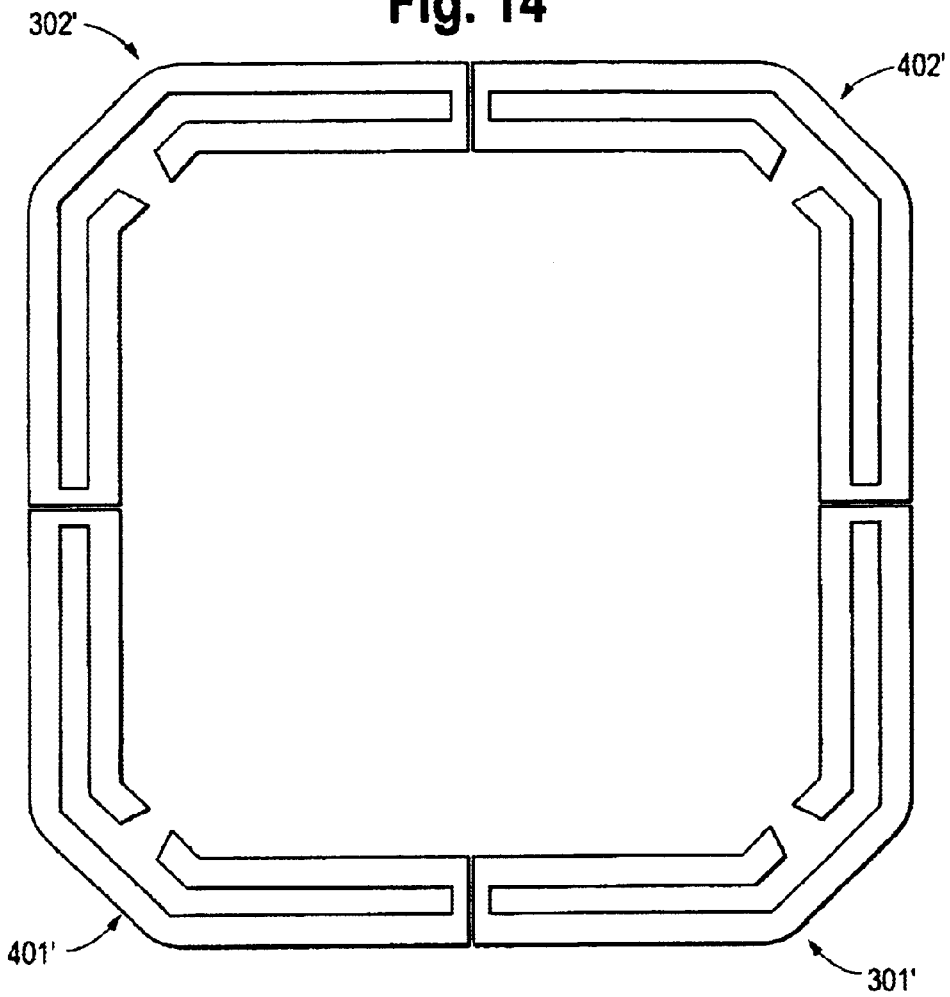
FIG. 14 is a plan view of an alternative radiating section configuration.

FIG. 5 shows an exemplary one of the radiating modules 500. The radiating module comprises radiating sections 301, 302, 401 and 402 arranged in a circular "box" configuration around a central region. An alternative "square "box" configuration is shown in FIG. 14. The radiating sections are similar in construction and only radiating section 302 will be described in full. Radiating section 302 includes a fed dipole (comprising a first quarter-wavelength monopole 304 and a second quarter-wavelength monopole 305) and a passive dipole 306, separated by a gap 331. End sections of the conductor (concealed in FIG. 5 beneath a clip 700) at opposing ends of the gap 331 electrically short the monopoles 304,305 with the passive dipole 306. The first quarter-wavelength monopole 304 is connected to the first dipole feed leg 324 at bend 330. The first dipole feed leg 324 is connected to the feed section 320 at a splitter junction 326. The second quarter-wavelength monopole 305 is connected to the second dipole feed leg 325 at bend 329. The second dipole feed leg 325 is connected to a 180° phase delay line 322 at bend 327. The phase delay line 322 is connected at its other end to the splitter junction 326. The length of the phase delay line 322 is selected such that the dipole feed legs 324 and 325 have a phase difference of 180°, thus providing a balanced feed to the fed dipole. It will be appreciated that the feed legs 324,325, radiating section and phase delay line 322 together define a closed loop. The phased line 322 and splitter junction 326 together act as a balun (a balanced to unbalanced transformer).

In a first alternative arrangement (not shown), the shorter feed path (that is, the feed path between the splitter junction 326 and the feed leg 324) may include two quarter-wave separated open half-wavelength stubs, as described in U.S. Pat. No. 6,515,628. The stubs compensate or balance the phase across the frequency band of interest.

In a second alternative arrangement (not shown), the balun formed by the splitter junction 326 and phase delay line 322 may be replaced by a Schiffman coupler as described in U.S. Pat. No. 5,917,456.

Together the dipole feed legs have an intrinsic impedance that is adjusted to match the radiating section 302 to the feed section. This impedance is adjusted, in part, by varying the width of the dipole feed legs 324, 325 and the gap 332. The bends are such that the dipole feed legs 324 and 325 are substantially perpendicular to the feed section 320 and the ground plane 101, and the radiating section 302 is substantially parallel to the feed section 320 and the ground plane 101. The radiating sections 301, 302, 401 and 402 are mechanically connected by dielectric clip 700, which is further described below. This connection provides greater stability and strength, and ensures correct spacing of the radiating sections.

Figure 6A:
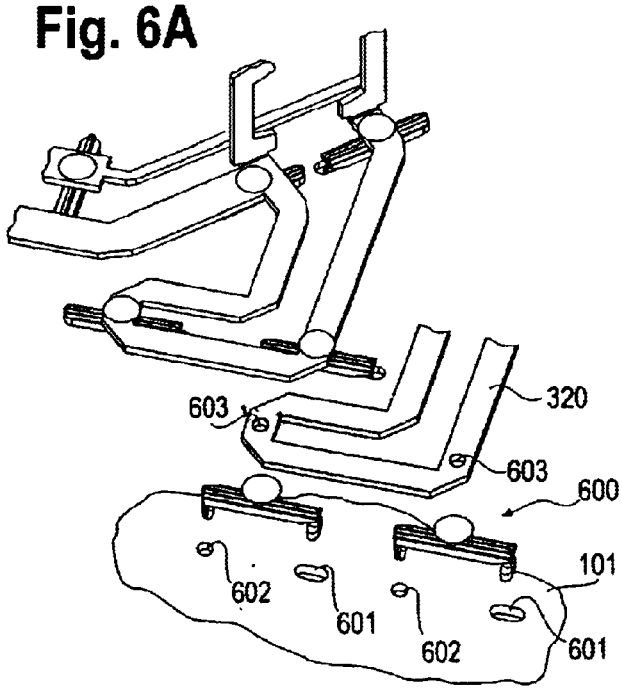
FIG. 6A is an isometric view showing the method of fixing the antenna units to the ground plane, in the antenna of FIG. 1.
Figure 6B:
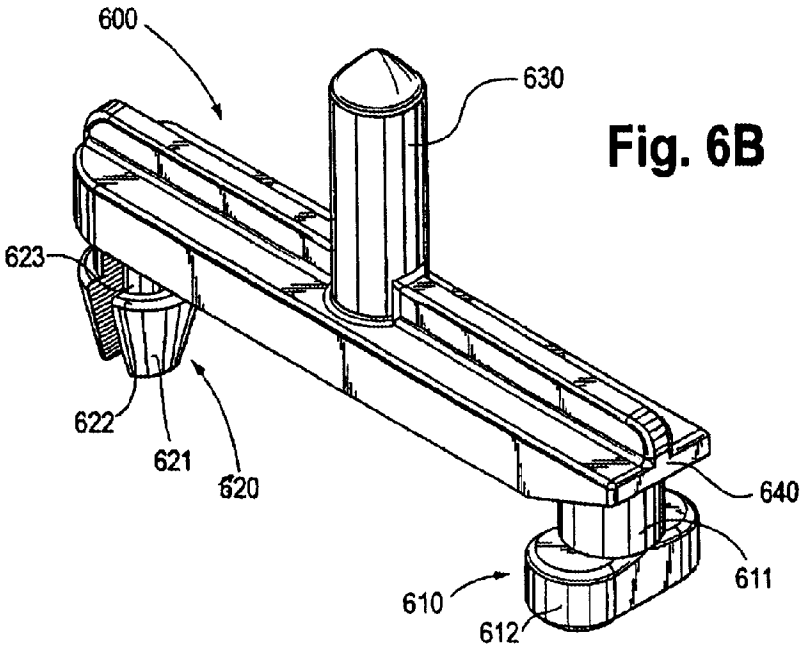
FIG. 6B is an isometric view of the dielectric spacer shown in FIG. 6A.

The microstrip antenna units 300 and 400 could be spaced from the ground plane 101 by any dielectric, such as air, foam, etc. In the preferred embodiment, the microstrip antenna units are spaced from the ground plane by air, and are fixed to the ground plane using dielectric spacers 600 shown in FIG. 6A and in detail in FIG. 6B, although other types of dielectric support could also be used. Other possible dielectric supports include nuts and bolts with dielectric washers, screws with dielectric washers, etc.

Figure 6C:
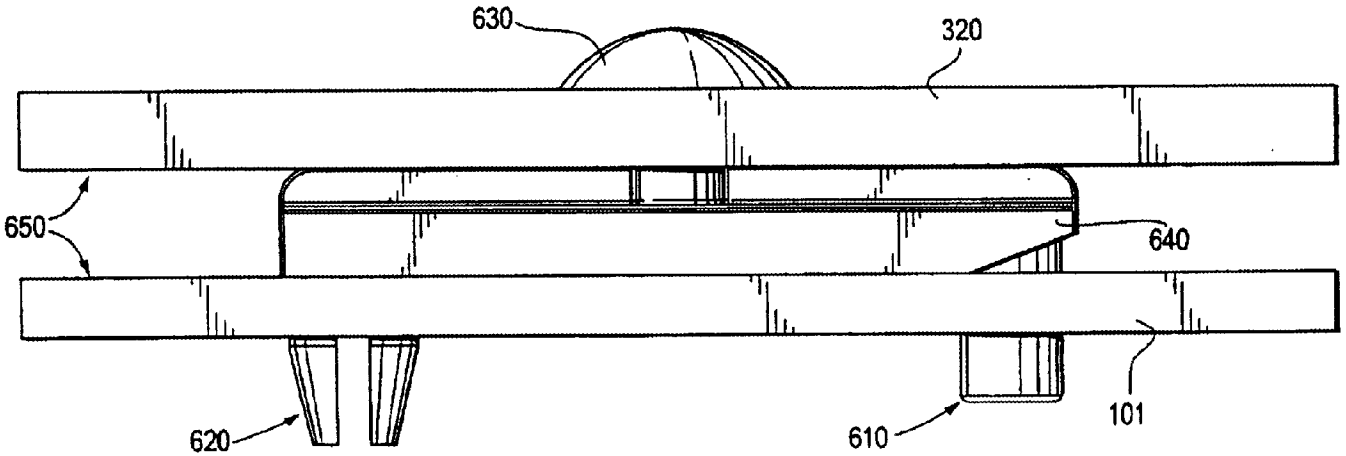
FIG. 6C is a side view of the assembled ground plane, dielectric spacer and antenna unit.

The dielectric spacers 600 have a body portion 640, stub 630, and lugs 610 and 620 which fit into a slot 601 and a hole 602 respectively in the ground plane. The lug 610 comprises a neck 611 and a lower transverse elongate section 612. The lug 620 comprises two legs having a lower sloping section 621, a shoulder 622 and neck 623. The legs are resilient so that they bend inwardly when forced through the hole 602 in the ground plane, and spring back when the shoulder 622 has passed through. To fix the dielectric spacer 600 to the ground plane 101 the elongate section 612 is passed through the slot 601; the dielectric spacer is rotated through 90 degrees, such that the elongate section cannot pass back through the slot 601; and the lug 620 is forced through the hole 602. The shoulders 622 and elongate section 612 are spaced from the body portion 640 by a distance corresponding to the thickness of the ground plane so that the dielectric spacer and ground plane are fixed together when the shoulders and elongated section engage the back side of the ground plane. The stub 630 is received in a hole 603 in the feed section 320 or 420. The top of the stub 630 is then deformed by heating such that the feed section 320 or 420, body portion 640 and ground plane 101 are fixed together, as shown in the cross-section of FIG. 6C. FIG. 6C also shows the air gap 650 between the air suspended microstrip feed section 320 and the ground plane 101. The spacer 600 is precisely machined so as to maintain a desired gap.

Figure 7A:
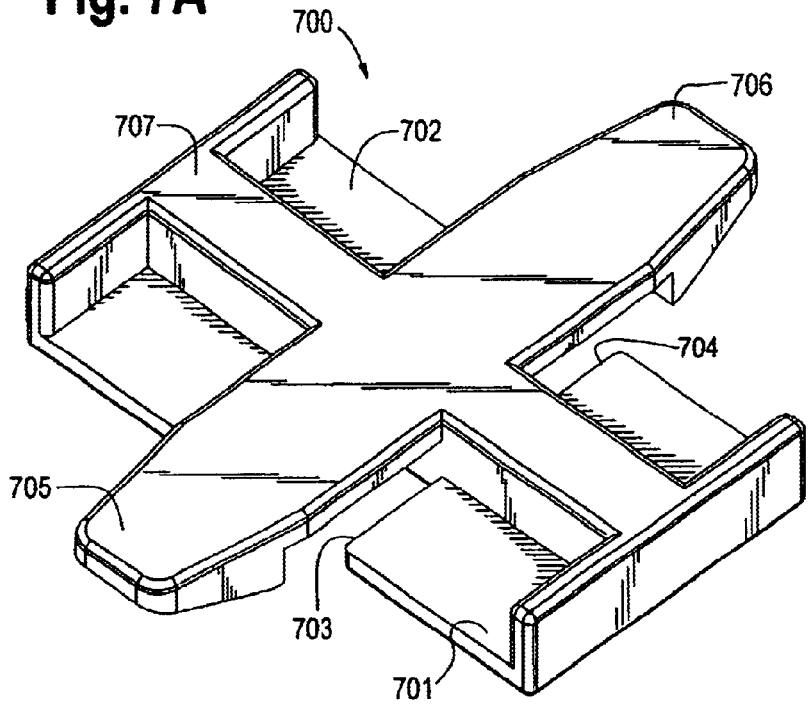
FIG. 7A is an isometric top view of the dielectric clip.
Figure 7B:
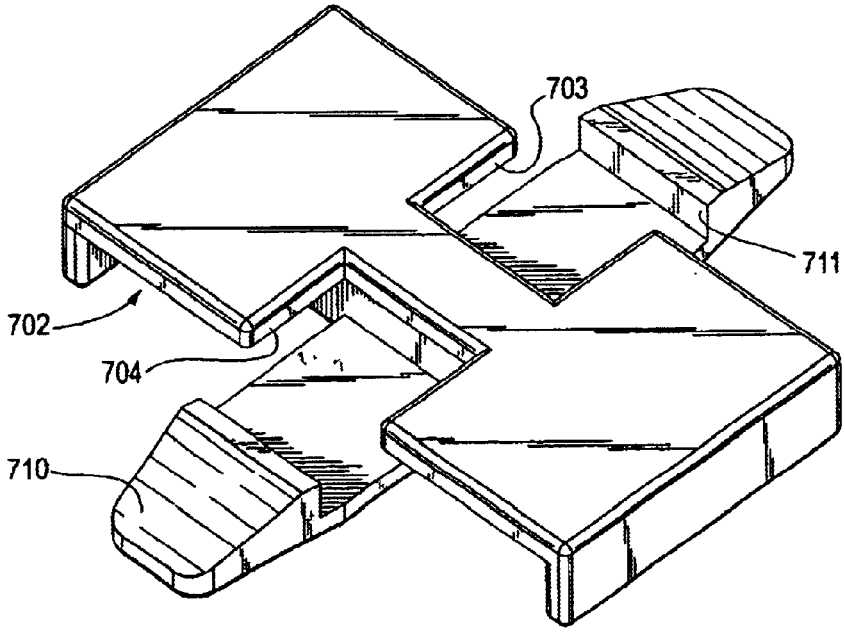
FIG. 7B is an isometric bottom view of the dielectric clip.

The dielectric clip 700 is shown in more detail in FIGS. 7A and 7B. The clip comprises a body portion formed with a longitudinal rib 707, and a pair of sockets 701,702 which receive the ends of the radiating sections 301,402. Slots 703,704 are provided in the base of the sockets 701,702. A pair of spring arms 705,706 extend transversely from the rib 707. The spring arms 705,706 are identical and are each formed with a catch at their distal end including an angled ramp 710 and locking face 711.

The clip is formed using a two-part mold, and the purpose of slots 703,704 is to enable the under-surface of spring arms 705,706 to be properly molded.

Figure 7C:
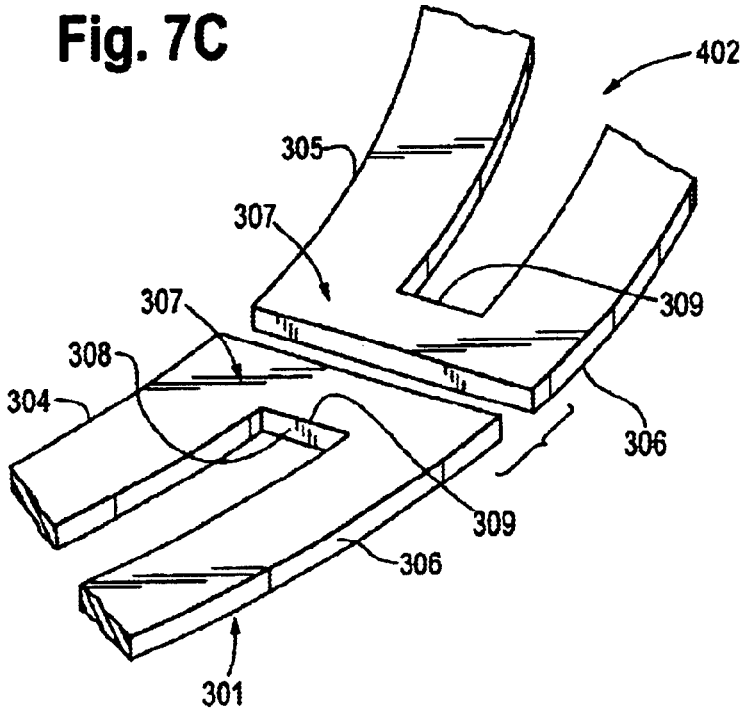
FIG. 7C is an isometric view of two adjacent radiating sections.
Figure 7D:
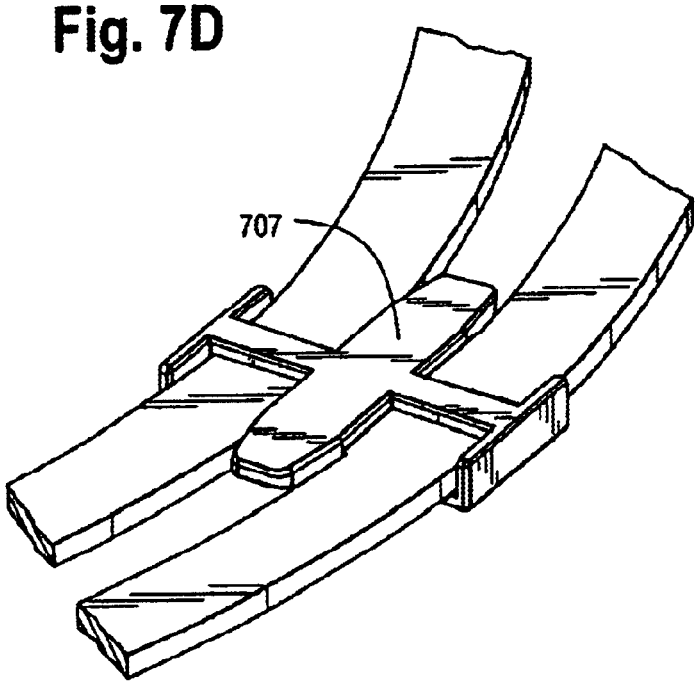
FIG. 7D is an isometric view of the radiating sections with a clip inserted.

FIG. 7C shows the ends of radiating sections 301,402 before the clip 700 is attached. The fed monopoles 304,305 are shorted to the passive dipole 306 by end sections 307. The end section 307 has an inner edge 309 and inner face 308. The clip 700 is mounted by pulling the radiating section 402 away to give sufficient clearance, and sliding the clip into place with the end section 307 received in the socket 701 as shown in FIG. 7D. As the clip slides into place, the ramp 710 (which partially obstructs the socket) engages the end section 307, causing the spring arm 705 to resiliently flex upwardly until the locking face 711 clears the inner edge 309 and snaps into engagement with the inner face 308 of the end section 307.

The other radiating section 402 is then snapped into the opposite socket 702 in a similar manner. With the clip in place as shown in FIG. 7C, the longitudinal rib 707 maintains a precise spacing between the radiating sections 301, 402.

Figure 8:
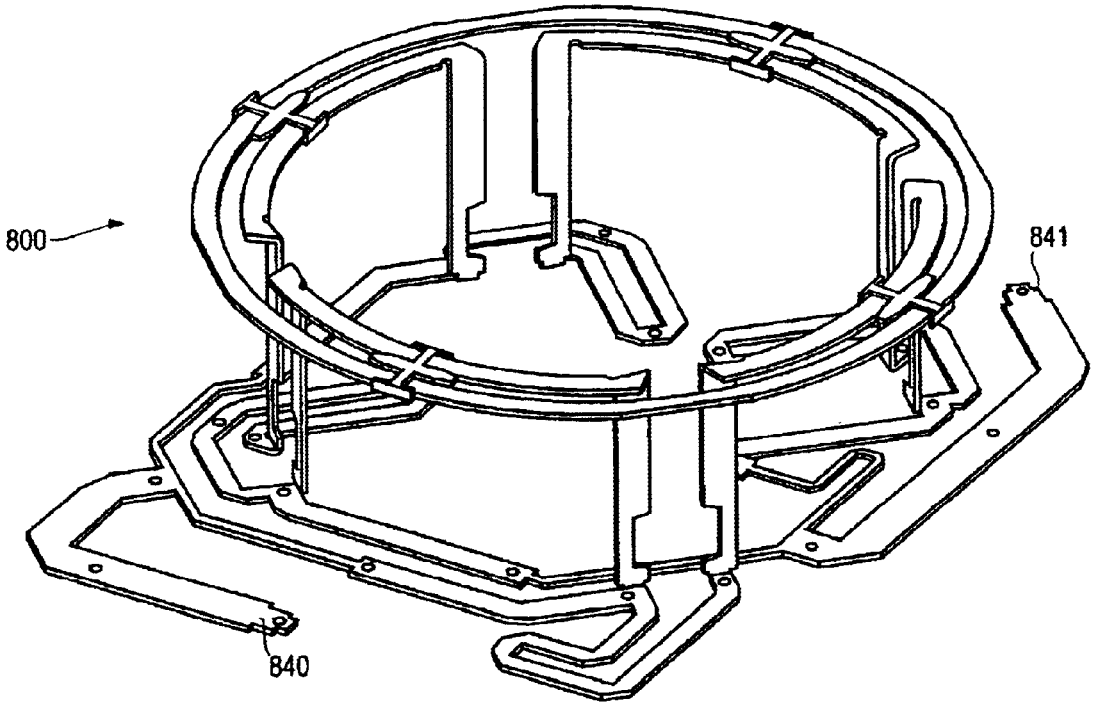
FIG. 8 is an isometric view of a dual polarization folded dipole antenna having a single radiating module, according to a second embodiment of the present invention.
Figure 9:
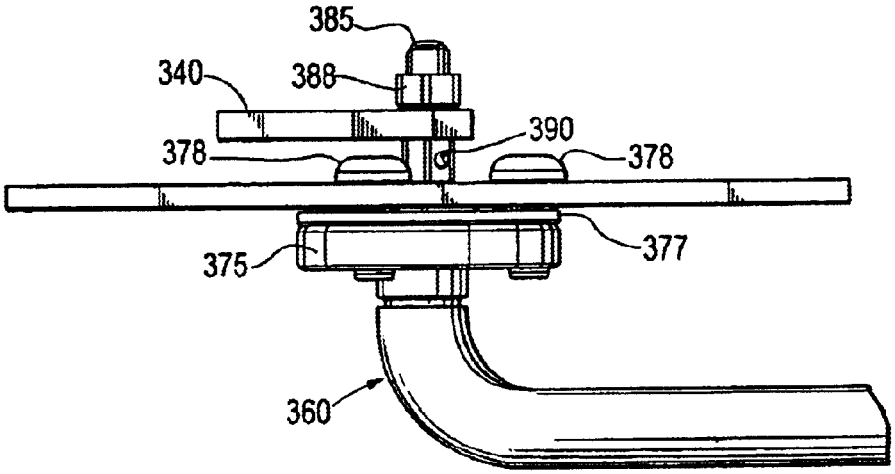
FIG. 9 is a side view of the coaxial to microstrip transition.
Figure 10:
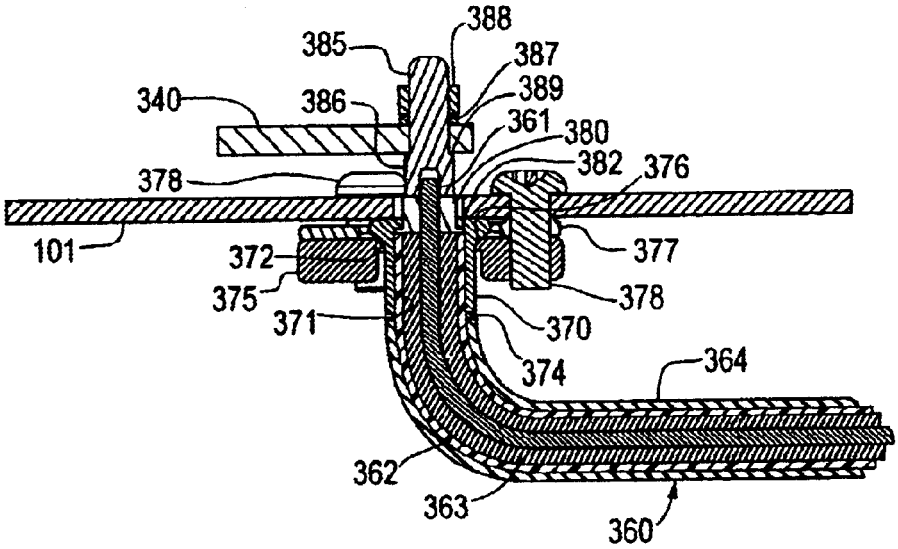
FIG. 10 is a cross-sectional view of the coaxial to microstrip transition of FIG. 9.
Figure 11:
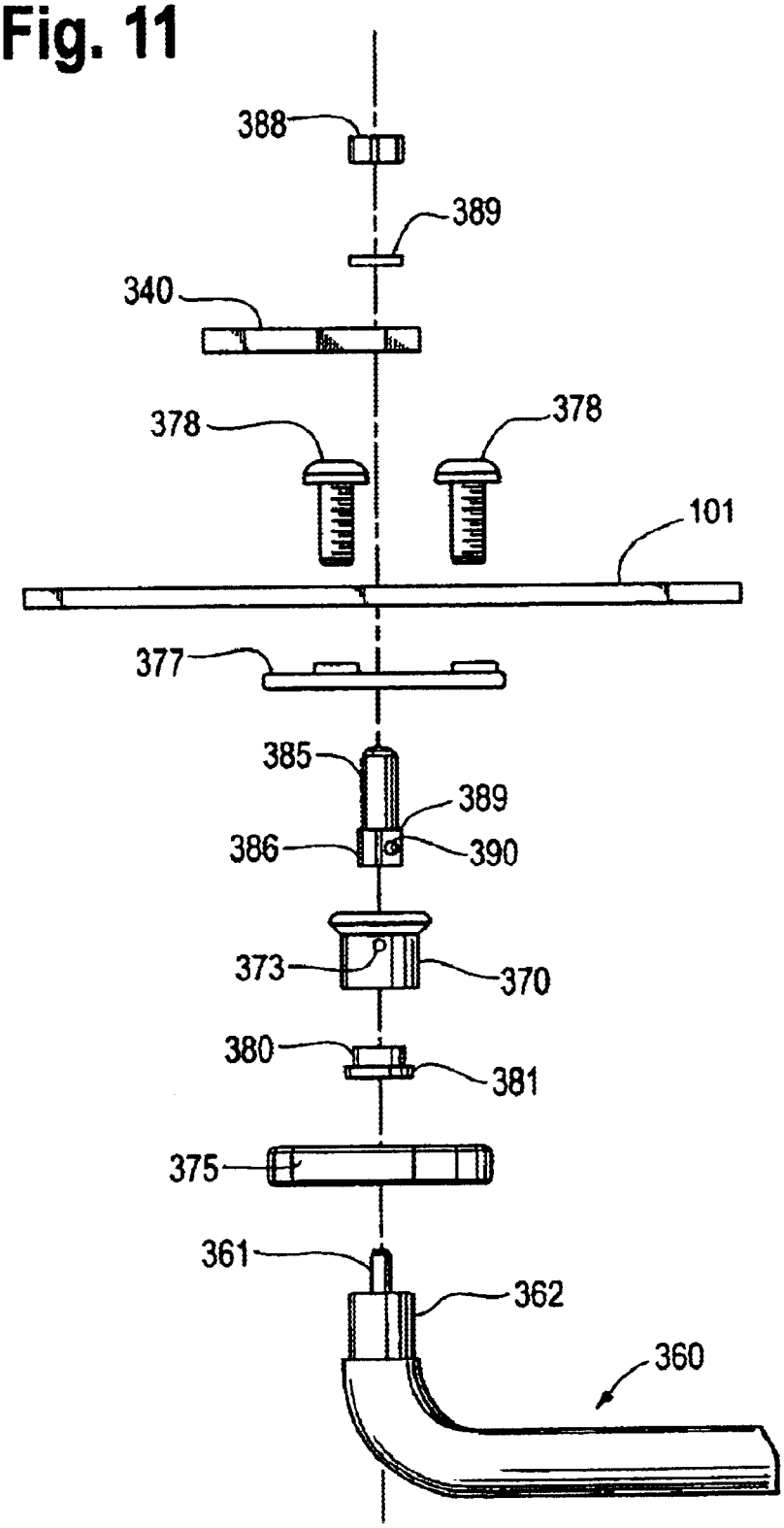
FIG. 11 is an exploded view of the coaxial to microstrip transition of FIG. 9.
Figure 12:
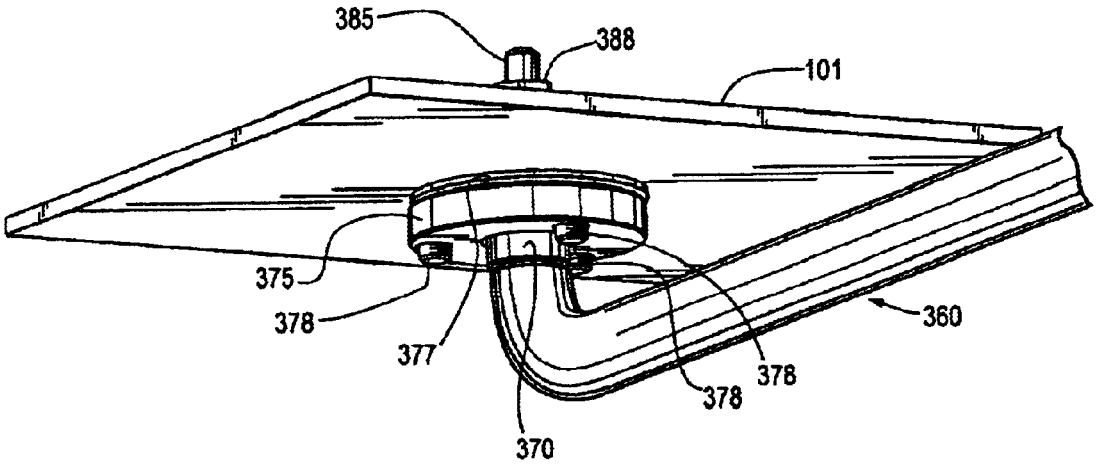
FIG. 12 is a first perspective view of the coaxial to microstrip transition of FIG. 9.
Figure 13:
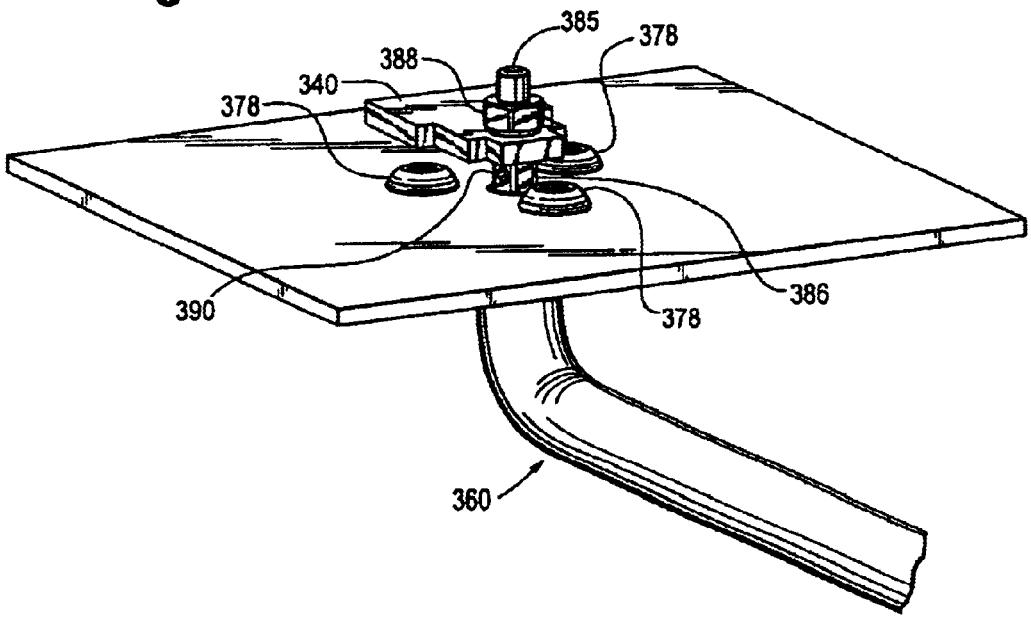
FIG. 13 is a second perspective view of the coaxial to microstrip transition of FIG. 9.

FIG. 8 shows a single dual polarization folded dipole antenna module 800 according to a second embodiment of the present invention. The ground plane and dielectric spacers are not shown. The antenna module 800 is identical to the module 500 shown in FIG. 5, except it is provided as a single self-contained module with inputs 840 and 841.

In a variable downtilt antenna (not shown), a number of single modules 800 can be arranged in a line and ganged together with cables, circuit-board splitters, and variable differential phase shifters for adjusting the phase between the modules. For instance, the differential phase shifters described in US2002/0126059A1 and US2002/0135524A1 may be used.

The transition coupling the coaxial transmission line 360 with the RF input section 340 is shown in FIGS. 9–13. The coaxial transmission line 360 has a central conductor 361 and a cylindrical coaxial conductive sheath 362 separated from the central conductor by a dielectric 363. An insulating jacket 364 encloses the sheath 362.

A metal ground transition body 370 has a cylindrical bore 371 which receives the sheath 362. The sheath 362 is soldered into the bore 371 by placing the cable into the bore, heating the joint and injecting solder through a hole 373 in the body 370 and into a gap 374 between the end of the body 370 and the jacket 364. The outer body 370 has an outer flange formed with a chamfered surface 372.

A metal transition ring 375 has a bore which receives the ground transition body 370. The bore has a chamfered surface 376 which engages the chamfered surface 372 of the body 370.

A plastic insulating washer 377 is provided between the transition ring 375 and the ground plane 101. The ground plane 101, washer 377 and transition ring 375 are provided with three holes which each receive an externally threaded shaft of a respective bolt 378.

The central conductor 361 extends beyond the end of the sheath, and is received in a bore of a plastic insulating collar 380. The collar 380 has a body portion received in a hole in the ground plane 101, and an outwardly extending flange 381 which engages an inwardly extending flange 382 of the ground transition body 370.

The three holes in the transition ring 375 are internally threaded so that when the bolts 378 are tightened, the chamfered surface 376 of the transition ring engages the chamfered surface 372 and forces the ground transition body 370 into conductive engagement with the ground plane 101. The chamfered surfaces 372,376 also generate a sideways centering force which accurately centers the coaxial cable.

It should be noted that this arrangement does not require any direct soldering between the ground transition body 370 and the ground plane 101.

A metal centre pin 385 is formed with a relatively wide base 386 which is hexagonal in cross-section, a relatively narrow shaft 385 which is externally threaded and circular in cross-section, and a shoulder 389. The base 386 has a cup which receives the central conductor 361, which is soldered in place. Soldering is performed by first placing a bead of solder in the cup, then inserting the conductor 361, heating the joint and injecting solder through a hole 390 in the base 386. The shaft 385 passes through a hole in the RF input section 340, and through a metal locking washer 387 and hexagonal nut 388.

When the nut 388 is tightened, the shoulder 389 is forced into conductive engagement with the RF input section 340. The parts are precisely machined so as to provide a desired spacing between the ground plane 101 and RF input section 340.

It should be noted that this arrangement does not require any direct soldering between the ground centre pin 385 and the RF input section 340.

The transition employs a mechanical joint between the ground plane 101 and the transition body 370, and between the centre pin base 386 and the RF input section. These mechanical joints are more repeatable than the solder joints shown in the prior art. The pressure of the mechanical joints can be accurately controlled by using a torque wrench to tighten the nut 388 and bolts 378. The ground plane 101 and RF input section 340 can be formed from a metal such as Aluminium, which cannot form a solder. joint.

An alternative dipole box configuration is shown in FIG. 14. In contrast to the "ring" structure shown in FIGS. 1,5 and 8, the radiating sections 301',302',401',402' are formed in a generally "square" structure. In common with the "ring", structure, the radiating sections are arranged in a "box" configuration around a central region. In a further alternative configuration (not shown) the four dipoles may be arranged in a "cross" configuration with the radiating sections extending radially from a central point.

The antennas shown in the figures are designed for use in the "cellular" frequency band: that is 806–960 MHz. Alternatively the same design (typically the cabled together version with a PCB power splitter) may operate at 380–470 MHz. Another possible band is 1710–2170 MHz. However, it will be appreciated that the invention could be equally applicable in a number of other frequency bands.

Figure 15:
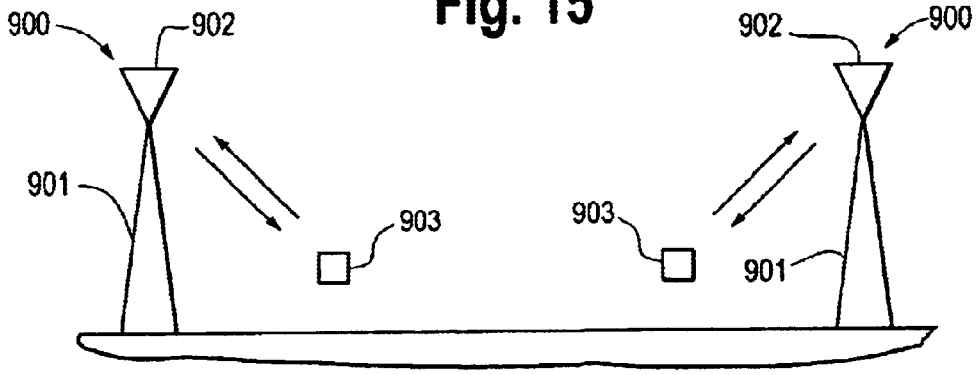
FIG. 15 is a schematic side view of a pair of base stations.

The preferred field of the invention is shown in FIG. 15. The antennas are typically incorporated in a mobile wireless communications cellular network including base stations 900. The base stations include masts 901, and antennas 902 mounted on the masts 901 which transmit and receive downlink and uplink signals to/from mobile devices 903 currently registered in a "cell" adjacent to the base station.

While the invention is susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the appended claims.

What is claimed is:

1. A dual polarized folded dipole antenna comprising:

a first unit configured for transmitting and/or receiving signals in a first polarization direction; and a second unit configured for transmitting and/or receiving signals in a second polarization direction different to the first polarization direction, wherein each unit includes a conductor having a feed section, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends.

2. A dual polarized folded dipole antenna according to claim 1 wherein the feed section is a microstrip feed section having an adjacent ground plane on one side only.

3. A dual polarized folded dipole antenna according to claim 1 further comprising a ground plane, wherein the feed section is an air suspended feed section separated from the ground plane by an air gap.

4. A dual polarized folded dipole antenna according to claim 1 wherein the antenna comprises a slant polarized antenna with two or more modules arranged along an antenna axis, wherein the first and second polarization directions are at an angle to the antenna axis.

5. A dual polarized folded dipole antenna according to claim 1 wherein the first unit includes a first pair of folded dipoles, the second unit includes a second pair of folded dipoles, each folded dipole including a respective radiator input section and a respective radiating section, and wherein the two pairs of radiating sections are arranged in a box configuration around a central region.

6. A dual polarized folded dipole antenna according to claim 5 wherein the box configuration is a ring configuration.

7. A dual polarized folded dipole antenna according to claim 5 wherein the box configuration is a square configuration.

8. A dual polarized folded dipole antenna according to claim 1 further comprising a ground plane, wherein the radiating sections extend substantially parallel with the ground plane.

9. A dual polarized folded dipole antenna according to claim 1 further comprising a ground plane, wherein the radiator input section includes a pair of feed legs which each extend substantially transversely to the ground plane.

10. A dual polarized folded dipole antenna according to claim 1 wherein the radiator input section includes a balun transformer.

11. A dual polarized folded dipole antenna according to claim 1 wherein the radiator input section includes a splitter, first and second feedlines which meet said feed section at said splitter so as to complete a closed loop including the first and second feedlines and the radiating section, and a phase delay element for introducing a phase difference between the first and second feedlines.

12. A folded dipole antenna comprising:

a ground plane a conductor having a feed section extending adjacent the ground plane and spaced therefrom by a dielectric, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends, wherein the feed section is a microstrip feed section having an adjacent ground plane on one side only, and wherein the radiator input section includes a balun transformer.

13. A folded dipole antenna according to claim 12 wherein the feed section is an air suspended feed section separated from the ground plane by an air gap.

14. A folded dipole antenna comprising:

a ground plane a conductor having a feed section extending adjacent the ground plane and spaced therefrom by a dielectric, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends, wherein the feed section is a microstrip feed section having an adjacent ground plane on one side only, and wherein the radiator input section includes a splitter, first and second feedlines which meet said feed section at said splitter so as to complete a closed loop including the first and second feedlines and the radiating section, and a phase delay element for introducing a phase difference between the first and second feedlines.

15. A folded dipole antenna according to claim 14 wherein the feed section is an air suspended feed section separated from the ground plane by an air gap.

16. A wireless mobile base station including an antenna according to claim 1.

17. A wireless mobile base station including an antenna according to claim 12.

18. A wireless mobile base station including an antenna according to claim 14.

* * * * *